US007328598B2

(12) United States Patent
Cramer et al.

(10) Patent No.: US 7,328,598 B2
(45) Date of Patent: Feb. 12, 2008

(54) DEVICE FOR COOLING ROLLING STOCK WITHIN THE COOLING STRETCH OF A ROLLING MILL

(75) Inventors: Ulrich Cramer, Attendorn (DE); Martin Braun, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/509,870

(22) PCT Filed: Feb. 27, 2003

(86) PCT No.: PCT/EP03/01999

§ 371 (c)(1),
(2), (4) Date: Oct. 1, 2004

(87) PCT Pub. No.: WO03/084686

PCT Pub. Date: Oct. 16, 2003

(65) Prior Publication Data

US 2005/0167897 A1 Aug. 4, 2005

(30) Foreign Application Priority Data

Apr. 6, 2002 (DE) ..... 102 15 229

(51) Int. Cl.
*B21B 45/02* (2006.01)

(52) U.S. Cl. ..... 72/201; 72/202; 72/342.2; 266/46

(58) Field of Classification Search ..... 72/200, 72/201, 202, 39, 43, 364, 251, 252; 266/111, 266/113, 46; 62/63, 64, 374; 198/785, 836.1
See application file for complete search history.

(56) References Cited

U.S. PATENT DOCUMENTS 4,247,047 A * 1/1981 Schaming ..... 239/391
4,497,180 A * 2/1985 Graham ..... 62/63

(Continued)

FOREIGN PATENT DOCUMENTS

| | | |
|---|---|---|
| BE | 1011579 | 11/1999 |
| DE | 198 43 038 A1 | 3/2000 |
| FR | 2580199 | 10/1986 |
| WO | 0030776 | 6/2000 |

OTHER PUBLICATIONS

Patent Abstracts of Japan, vol. 1999, No. 13, Nov. 30, 1999 & JP 11 226625 A (Mitsubishi Heavy IND LTD), Aug. 24, 1999.

(Continued)

*Primary Examiner*—Dmitry Suhol
(74) *Attorney, Agent, or Firm*—Friedrich Kueffner

(57) ABSTRACT

The invention relates to a device for cooling rolling stock within the cooling stretch of a rolling mil, especially a hat-strip mill, whereby water spray devices are stationarily mounted below the rolling stock between rollers (10) of a roller train (1) and spray bars (3) held on support levers (16) are arranged above the rolling stock. The support levers are held be a tubular, rotationally driven and water-fed articulated tube (15) that extends in parallel to the longitudinal axis of the roller train. The device is further provided with a central water feed tube and an automatic control device with associated on/off valves for switching the cooling water on and off. The aim of the invention is to improve a device of the aforementioned kind in such a manner that the maximum cooling capacity to be obtained is increased while the length of the roller train required therefor is reduced, thereby attaining a compact design and high cooling capacity. According to the invention, the rollers of the roller train are therefore spaced as closely together as possible, the lower cooling bars (2) are disposed in the spaces remaining between the rollers and extend through these spaces with spray tubes (13) associated therewith. Furthermore, the rollers of the roller train are provided with elongated pins (11) that have a small diameter.

13 Claims, 6 Drawing Sheets

U.S. PATENT DOCUMENTS

| | | | | |
|---|---|---|---|---|
| 4,570,453 | A * | 2/1986 | Kamio et al. | 62/375 |
| 4,643,013 | A * | 2/1987 | Blazevic | 72/252 |
| 4,723,562 | A | 2/1988 | Wilmotte et al. | |
| 4,945,746 | A * | 8/1990 | Jakimowicz et al. | 72/251 |
| 5,146,759 | A * | 9/1992 | Eguchi et al. | 62/64 |
| 5,327,763 | A * | 7/1994 | Kramer et al. | 72/257 |
| 6,062,056 | A | 5/2000 | Groch | |
| 6,301,906 | B1 * | 10/2001 | Thiel et al. | 62/64 |

OTHER PUBLICATIONS

Patent Abstracts of Japan, vol. 018, No. 578 (C-1269), Nov. 7, 1994 & JP 06 212278 A (Kawasaki Steel Corp), Aug. 2, 1994.

Patent Abstracts of Japan, vol. 010, No. 342 (M-536), Nov. 19, 1986 & JP 61 144212 A (Mitsubishi Heavy IND LTD), Jul. 1, 1986.

* cited by examiner

DEVICE FOR COOLING ROLLING STOCK WITHIN THE COOLING STRETCH OF A ROLLING MILL

The invention concerns a device for cooling rolling stock within the cooling line of a rolling mill, especially a hot strip rolling mill, in which stationary water spray devices are installed below the rolling stock between the rollers of a roller table, and spray bars held on support levers are installed above the rolling stock, wherein the support levers are supported by a tubular, rotationally driven and water-fed articulated tube that extends parallel to the longitudinal axis of the roller table, with a central water feed pipe and an automatic control device with associated on-off valves for switching the cooling water on and off.

Devices for cooling rolling stock are permanent parts of every rolling mill. They have become more important since certain metallurgical states, e.g., grain sizes, and the high working stress of the rolled product associated with these metallurgical states have been strived for by influencing the transformation of the steel.

For example, EP 0 178 281 B1 describes equipment for cooling a metal product with flat upper and lower sides, especially sheet metal, which is moved on a roller conveyor, wherein coolant for the lower side is fed into the gaps formed between the rollers of the roller conveyor, and another device is provided above the rolling stock, whose distance from the rolling stock can be varied. Disadvantages of this well-known cooling equipment are the comparatively high material expense and especially the costly on-site installation work, which results in relatively high construction costs.

DE 198 43 038.8 describes a device for cooling rolling stock, in which spray bars that deliver cooling water from above are supported in such a way that they can swivel and are partially balanced by counterweights to simplify the operation. By combining the cooling water feed lines, the resulting installation costs can be favorably affected.

This objective is achieved by the measures specified in claim 1. Modifications of the cooling device of the invention are specified in the dependent claims.

The features of the invention are explained in detail in the following description of the embodiment of the invention illustrated in the drawings.

Figure 1:
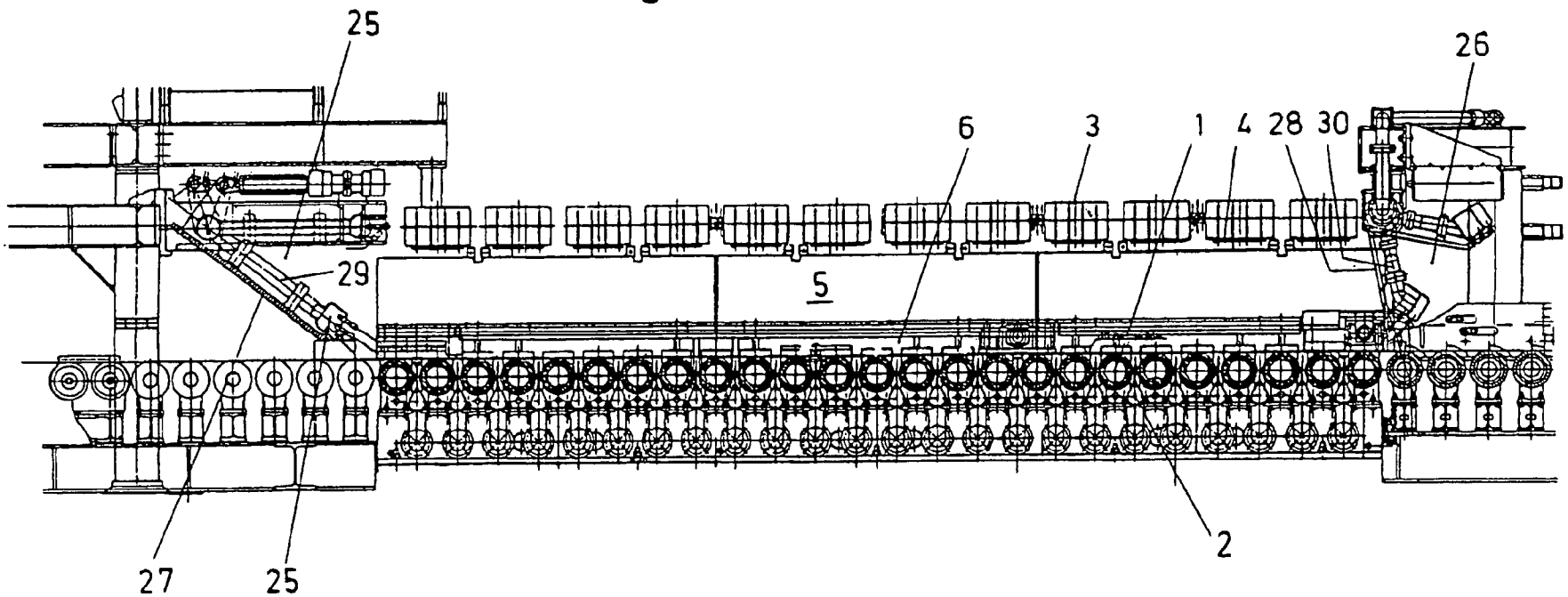
FIG. 1 shows a longitudinal section of the compact design of the cooling system with a conveyor roller table, a strip guide and longitudinal strip spraying devices.

FIG. 1 shows a roller table modified into a compact cooling device. Lower cooling bars 2 are seen slightly below the gaps between the rollers of this roller table 1. Spray bars 3, which are terminated at the bottom by interchangeable spray tube plates 4 with spray tubes, are shown above the roller table. Swiveling spray guard plates 5 articulate with the spray bars 3 and are designed to protect the surrounding area from sprayed water and to ensure that used spray water flows downward. The drawing also shows strip guide straightedges 6, which serve to align and centrally guide the hot strip running into the roller table.

Figure 2:
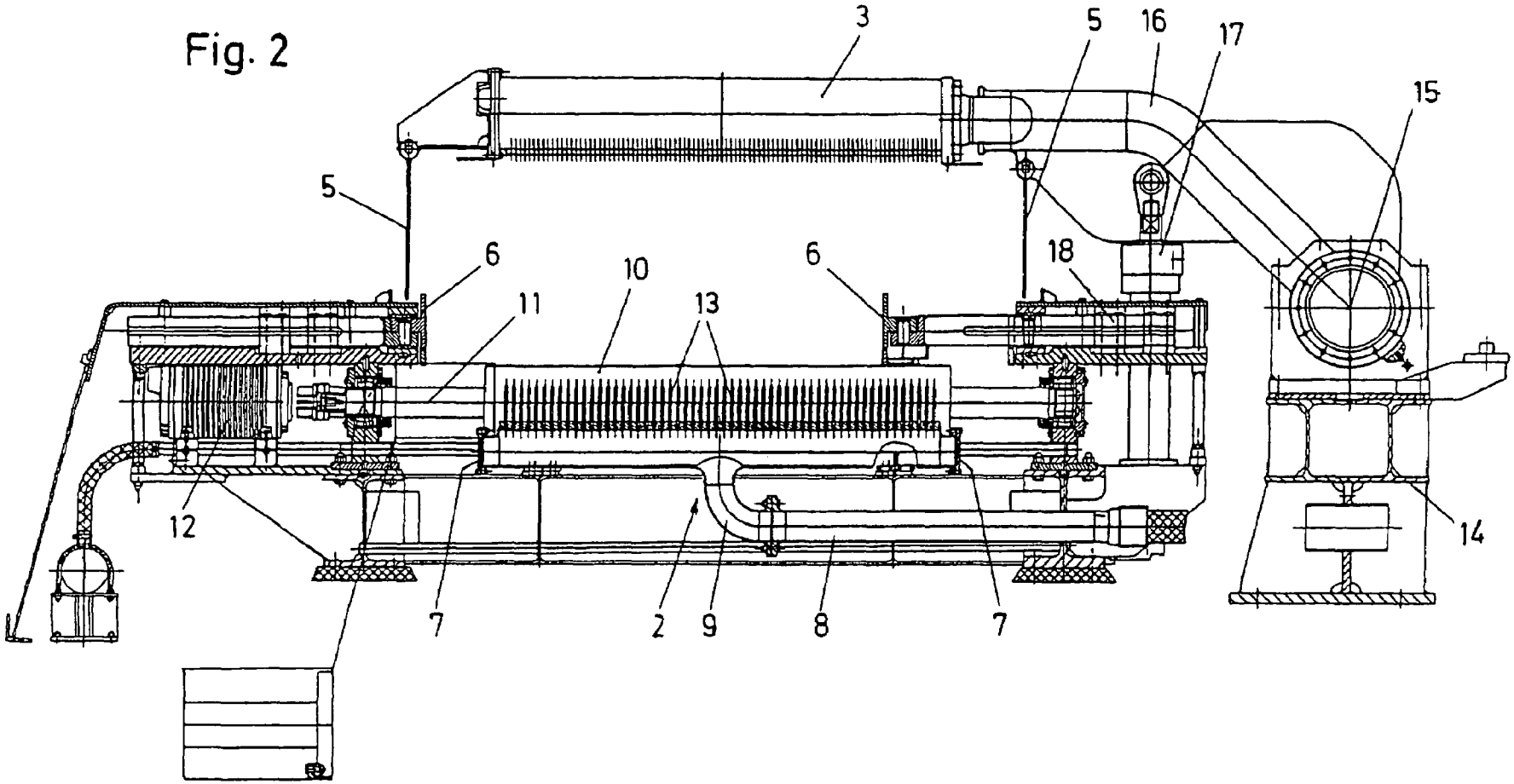
FIG. 2 shows a cross section of the cooling system in FIG. 1 with conveyor roller table, strip guide, and swiveling device for the upper spray bars.

The arrangement of the cooling bars, spray bars, and strip guide straightedges is shown in detail in FIG. 2, which is drawn to a larger scale and shows a cross section of the roller table 1 in the center plane of a lower cooling bar.

The cooling bar 2 is closed at both ends by caps 7, which can be removed, for example, for cleaning. The cooling bar 2 is fed through a cooling water pipe 8 via a manifold 9. The rollers 10 of the roller table 1 are provided with long, slender pins 11, which support the rollers in bearings and transmit the drive from the roller table motors 12. The rollers 10 are arranged with very narrow spacing, and the spray tubes 13 of the cooling bar 2 fit into the narrow spaces between them. However, this allows only small amounts of cooling water to flow off between the rollers 10; all the more space is offered for the water to flow off between the long, slender pins 11 of the rollers 10.

In this connection, the strip guide straightedges 6 are shown again in this drawing. The guide straightedge shown on the left is pulled back for maximum strip widths or for a home position and thus opens the area of the pins of the rollers for water to flow off from the very start. On the other hand, the guide straightedge shown on the right is pushed extremely far forward and thus largely covers the runoff route formed between the pins 11 of the rollers 10. Therefore, during practical operation, when the strip is run in, the strip guide straightedges 6 are set to the width of the strip that is running in, and after the strip has been run in, the cooling system is turned on, and the strip guide straightedges are pulled back into their home position of maximum opening.

The placement of the upper spray bar 3 is also shown in the drawing. A rotating articulated tube 15, which is fed with cooling water in the axial direction, is supported by means of one or more stands 14. Tubular support arms 16, into which the cooling water of the articulated tube 15 can enter, are connected to the articulated tube 15. Two parallel spray bars 3 are connected to each of these support arms and are supplied with cooling water through the tubular support levers 16. On the underside, the spray bars 3 are supplemented by interchangeable and adaptable spray tube plates 4, and the free ends support the articulated spray guard plates 5. Each of the support levers is supported by a hydraulic cylinder 17 and can be swung upward by the hydraulic cylinder from its working position shown in FIG. 2 into the position shown in FIG. 3 to perform repairs and inspections or to allow strips to be removed from the roller table.

Figure 4:
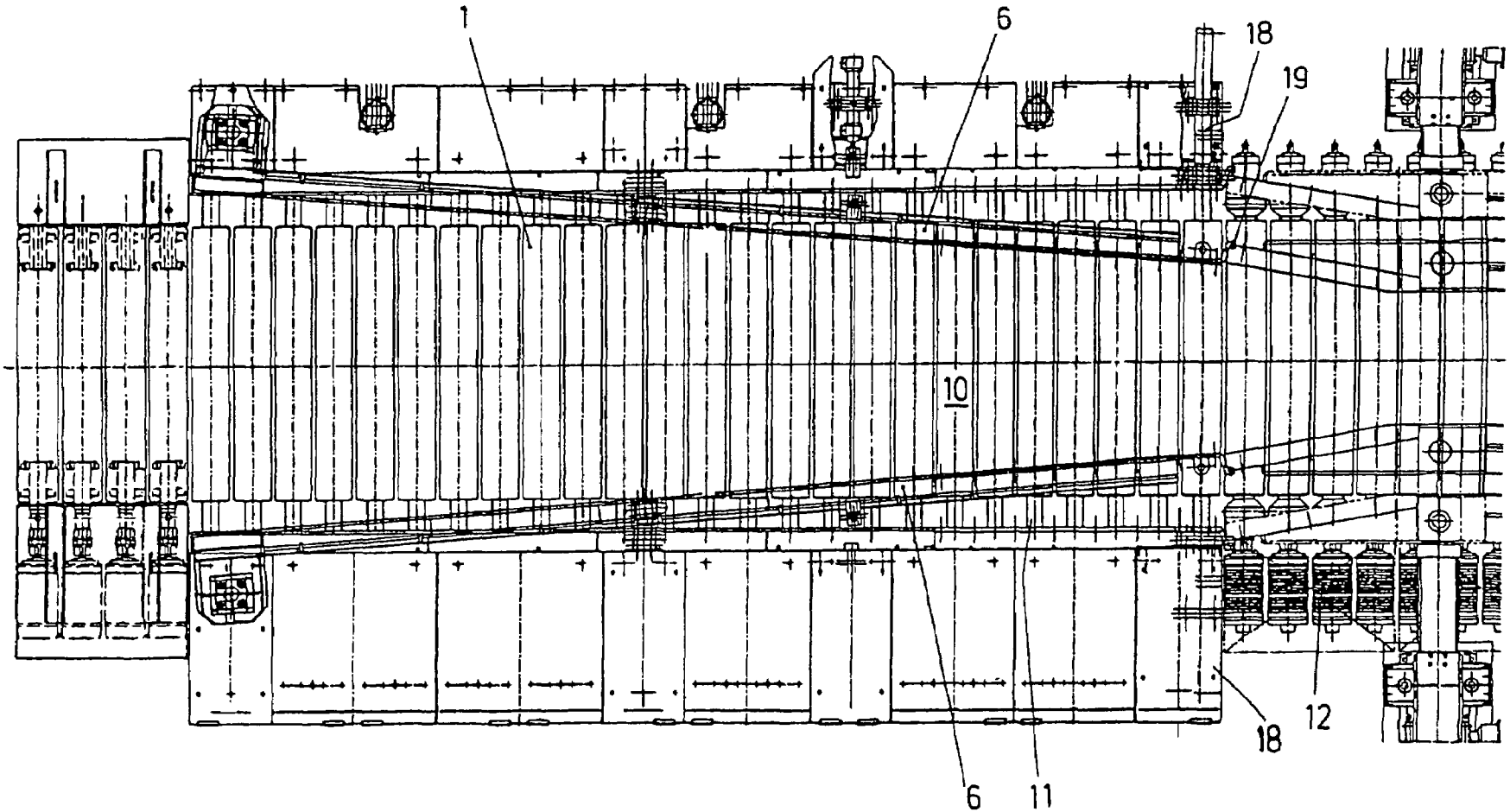
FIG. 4 shows a top view of a section of the roller table with a system for guiding the strip.

FIG. 4 shows a top view of the strip guide straightedges 6 of the roller table. The two adjusting devices 18 for the guide straightedges 6 have adjusted to a narrow strip width, so that the straightedges are above the cylindrical surfaces of the rollers 10 themselves: As has already been explained, after the strip has been run in, the guide straightedges 6 are opened to their maximum extent, so that the relatively large spaces formed between the pins 11 of the rollers 10 are able to carry off the cooling water delivered by the spray bars 3 and possibly by the cooling bars 2.

Figure 5:
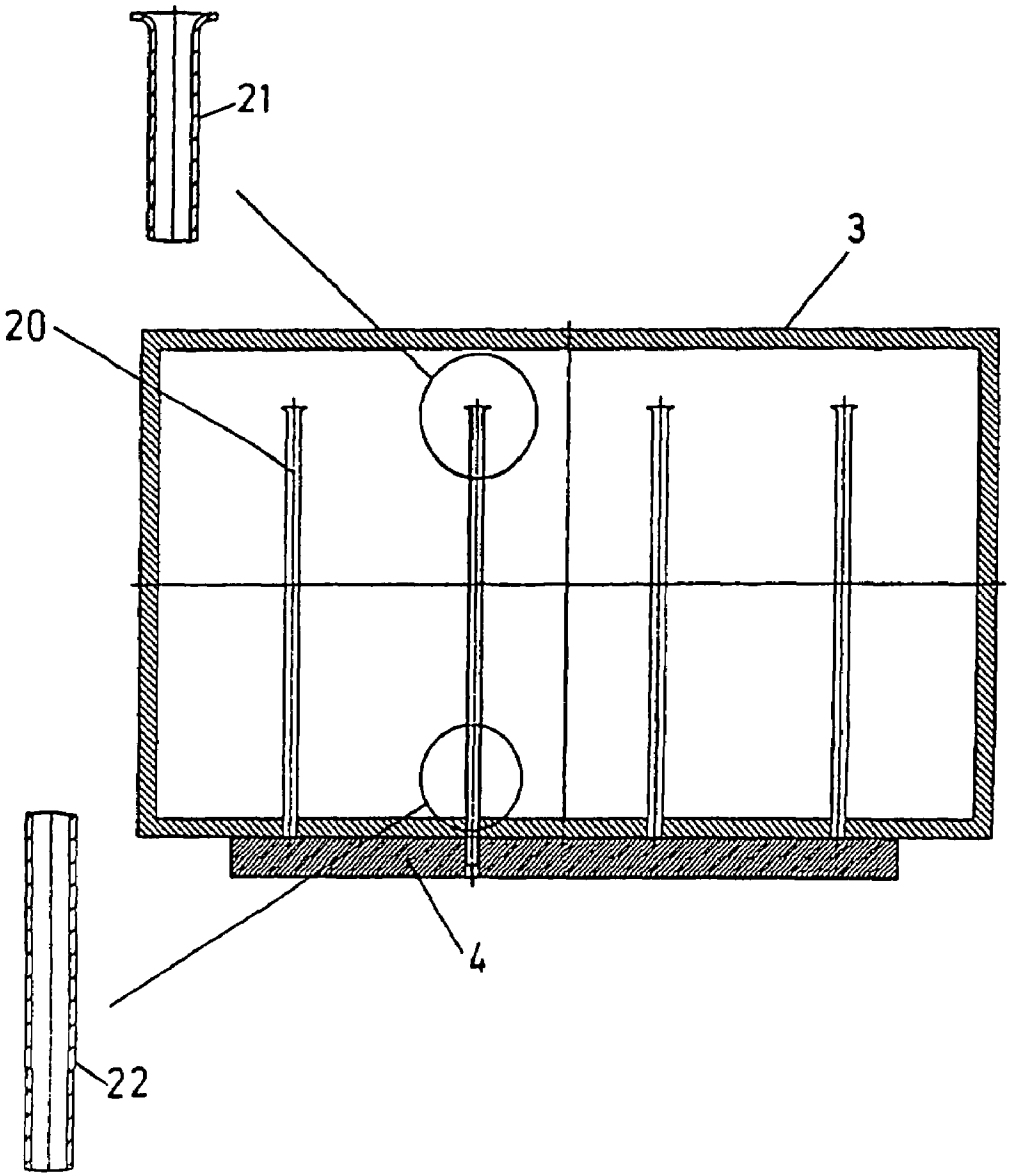
FIG. 5 shows a schematic vertical section of a spray bar with spray tube plate and spray tubes.

The design of the spray bars 3 is illustrated in FIG. 5, which shows a cross section on a larger scale. The drawing shows a spray tube plate 4 mounted below the spray bar 3 and a number of spray tubes 20. As the enlarged detail drawings show, the free, water-carrying mouth region 21 of the spray tubes 20 is expanded like a funnel to allow the water flowing in to be carried without throttling. On the other hand, the discharge region 22 is either cylindrical or constricted, usually only slightly, but in any event to the extent required to achieve the desired spray velocity. There are several mounting possibilities: The spray tubes 20 can be mounted in the spray tube plate 4, or they can be designed to be replaceable, in case a change or replacement becomes necessary due to wear or due to the need to use different dimensions.

Figure 3:
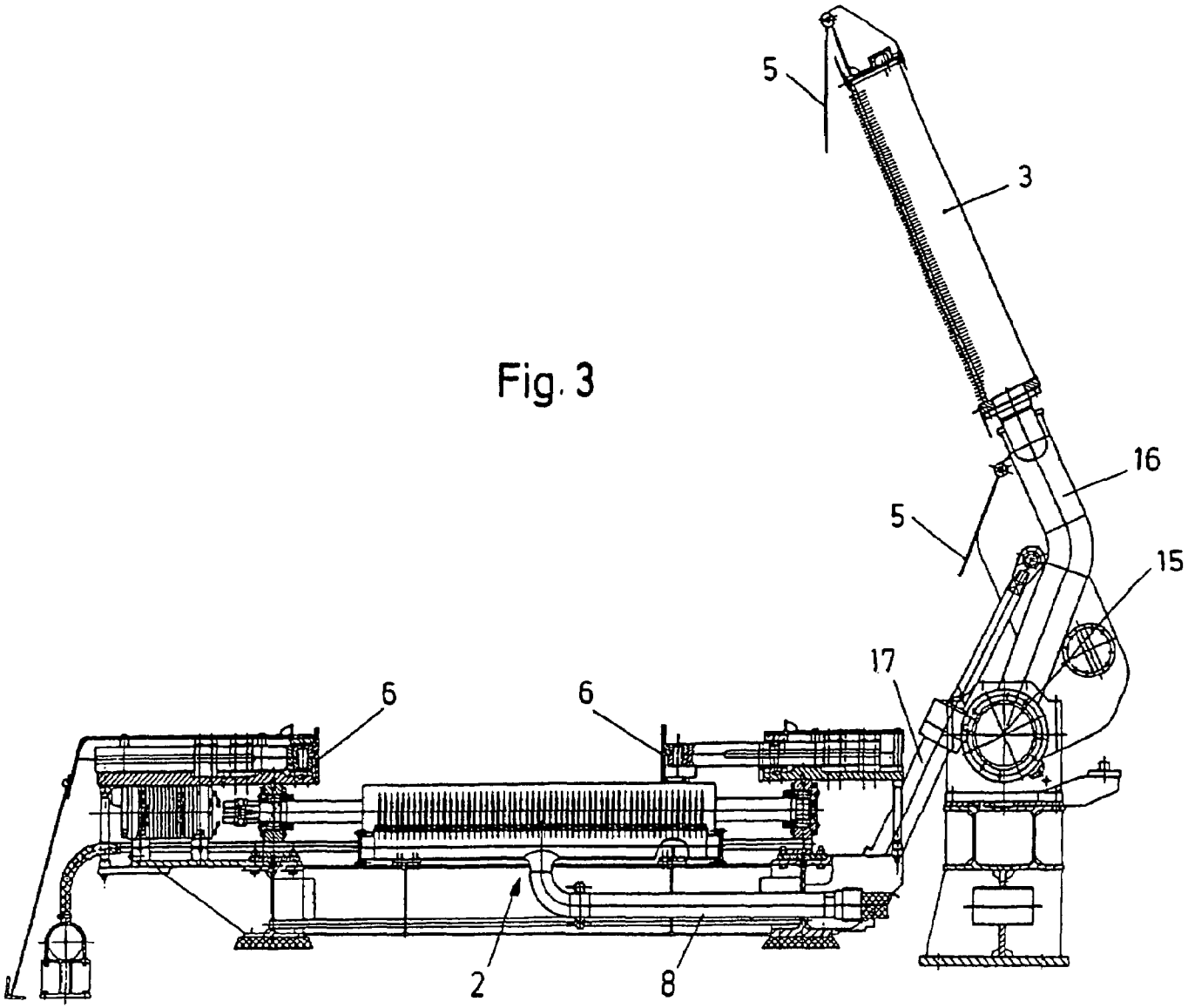
FIG. 3 shows the same cross section of the roller table as in FIG. 2 but drawn to a slightly smaller scale and with the spray bar raised.
Figure 6:
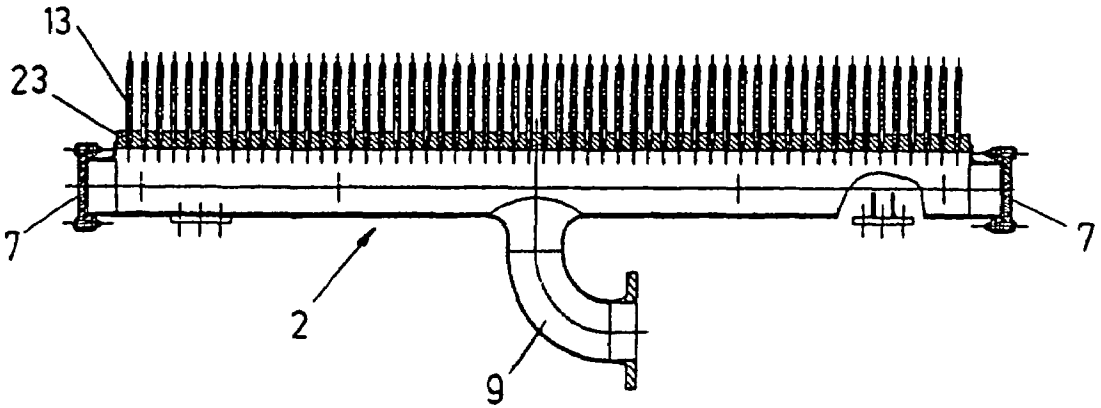
FIG. 6 shows a vertical longitudinal section of one of the lower cooling bars.

FIG. 6 again shows one of the lower cooling bars 2 in a side view. The removable caps 7 that seal the cleaning or inspection opening and the manifold 9 for connecting the cooling water pipe 8 of FIGS. 2 and 3 are also shown here.

Figure 7:
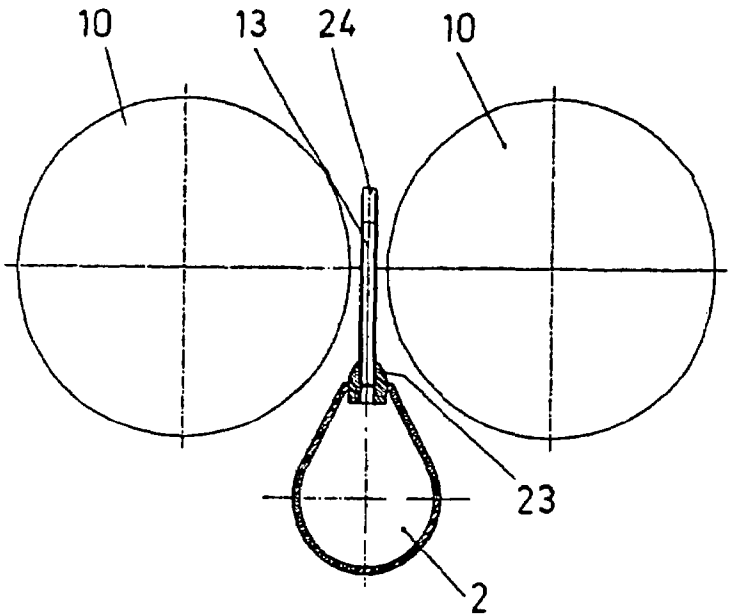
FIG. 7 shows a schematic cross section of two adjacent rollers of a roller table with lower cooling bars with spray tubes provided between and under them.

However, as especially FIG. 7 shows, the space formed between two adjacent rollers 10 of the roller table 1 is very narrow, so that the supply of cooling water from below and the drainage of the cooling water running off from above become critical in such a compact arrangement. This problem is solved here by arranging the actual body of the cooling bar 2 below the center horizontal lines of the rollers 10 and at the same time providing a pear-shaped design of the cross section of the cooling bar in the direction of the streamlined body. This body is terminated above by a retaining strip 23, whose bores hold the spray tubes 13, which terminate at their upper end in a nozzle 24 that determines their spray pattern.

As FIG. 1 shows, the compact cooling system is supplemented by longitudinal spray devices 25 and 26, which can be swiveled and switched, at the inlet and outlet ends. These ensure that the cooling water present on the upper side of the strip due to the delivery of abundant cooling water cannot flow or be conveyed by the strip into the area of the technological measuring instruments, where they would distort or falsify the measurement results. These longitudinal spray devices 25 and 26 consist of swinging flaps 27 and 28 with nozzle tubes 29 and 30. When the strip is being run in, the flaps are swung up to ensure trouble-free passage of the strip. The flaps 27, 28 are then lowered for operation, and the nozzle tubes 29, 30 are turned on. After the flaps and nozzle tubes have been lowered, the nozzles are located directly above the surface of the strip to ensure effective nozzle jet action. The flaps protect the nozzles and can turn upward in the event of problems with the strip flow, e.g., looping, without any significant damage to the longitudinal spray devices.

| Reference Numbers | |
|---|---|
| 1 | roller train |
| 2 | lower cooling bar |
| 3 | upper spray bar |
| 4 | spray tube plate (3) |
| 5 | spray guard plate |
| 6 | strip guide straightedge |
| 7 | cap (2) |
| 8 | cooling water pipe (2) |
| 9 | manifold (2) |
| 10 | roller (1) |
| 11 | pin (10) |
| 12 | motor (10, 11) |
| 13 | spray tube |
| 14 | stand |
| 15 | rotating articulated tube |
| 16 | support lever (15) |
| 17 | hydraulic cylinder (16) |
| 18 | adjusting device (6) |

-continued

| Reference Numbers | |
|---|---|
| 19 | stop (6) |
| 20 | spray tubes |
| 21 | mouth region |
| 22 | discharge region (19) |
| 23 | retaining strip (2) |
| 24 | nozzles (13) |
| 25, 26 | longitudinal spray systems |
| 27, 28 | flaps (25, 26) |
| 29, 30 | nozzle tubes (25, 26) |

The invention claimed is:

1. Device for cooling rolling stock within the cooling line of a rolling mill, especially a hot strip rolling mill, in which stationary water spray devices are installed below the rolling stock between rollers (10) of a roller table (1), and spray bars (3) held on support levers (16) are installed above the rolling stock, wherein the support levers (16) are supported by a tubular, rotationally driven and water-fed articulated tube (15) that extends parallel to the longitudinal axis of the roller table (1), with a central water feed pipe and an automatic control device with associated on-off valves for switching the cooling water on and off, wherein the rollers (10) of the roller table (1) are arranged with the closest possible spacing; wherein the lower cooling bars (2) are arranged below the spaces remaining between the rollers (10); wherein spray tubes (13) of the cooling bars (2) fit into these spaces; and the rollers (10) of the roller table (1) have elongated pins (11) of small diameter so as to permit cooling water which cannot run off through the spacing between the rollers to run off over the small diameter pins, wherein the cooling bars (2) have a pear-shaped cross section, whose neck is directed towards the spaces remaining between the rollers (10) and is furnished with the spray tubes (13), wherein the neck of the pear-shaped cross section of the cooling bars (2) is terminated by a retaining strip (23), which is fitted with spray tubes (13) and advantageously is interchangeable, wherein the free end of each spray tube (13) is fitted with a nozzle (24).

2. System in accordance with claim 1, comprising an articulated tube (15), which carries cooling water and is supported by stands (14) in such a way that it can swivel, and from which tubular support arms (16) originate, which convey cooling water and both support the upper spray bars (3) and supply cooling water to them.

3. System in accordance with claim 2, comprising at least one drive mechanism associated with the articulated tube (15).

4. System in accordance with claim 3, comprising a hydraulic cylinder (17) that acts on a lever connected with the articulated tube (15).

5. System in accordance with claim 4, wherein the hydraulic cylinder (17) acts on a section of a support lever.

6. System in accordance with claim 1, comprising spray guard plates (5) that articulate in front of end faces of the spray bars (3).

7. System in accordance with claim 1, comprising guide straightedges (6), which can be advanced towards stops (19) representing the strip width to be processed and can be retracted to their wide-open home position at the start of the intensive compact cooling.

8. System in accordance with claim 1, wherein spray tube plates (4) that are provided with spray tubes (20) can be detachably or interchangeably mounted on the underside of the upper spray bars (3).

9. System in accordance with claim 8, wherein the front free ends of the mouth regions (21) of the spray tubes (20) are expanded like funnels, and the lower ends in the discharge regions (22) are constricted, if necessary, to the desired cross section.

10. System in accordance with claim 1, wherein the ends of the cooling line of the roller table (1) are preferably equipped with systems (25, 26) for longitudinal spraying.

11. System in accordance with claim 10, wherein flaps (27, 28) that can be lowered are installed in front of the longitudinal spray systems.

12. System in accordance with claim 10, wherein the longitudinal spray systems (25, 26) are equipped with nozzle tubes (29, 30) that are acted upon by pressurized water and/or compressed air.

13. System in accordance with claim 12, wherein the tubes that carry the nozzles can be raised into an open position.

* * * * *